US011725913B2

(12) United States Patent
Alexandre et al.

(10) Patent No.: US 11,725,913 B2
(45) Date of Patent: Aug. 15, 2023

(54) SETUP FOR LOCATING IMPACTS WITH INTERACTIVE PLATE AND TRANSDUCERS

(71) Applicant: Commissariat à l'énergie atomique et aux énergies alternatives, Paris (FR)

(72) Inventors: Jean-Marc Alexandre, Verrieres-le-Buisson (FR); Robert Boden; Christian Bolzmacher, Montrouge (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 142 days.

(21) Appl. No.: 17/292,961

(22) PCT Filed: Nov. 8, 2019

(86) PCT No.: PCT/FR2019/052663
§ 371 (c)(1),
(2) Date: May 11, 2021

(87) PCT Pub. No.: WO2020/099764
PCT Pub. Date: May 22, 2020

(65) Prior Publication Data

US 2022/0003527 A1 Jan. 6, 2022

(30) Foreign Application Priority Data

Nov. 12, 2018 (FR) ..... 1871478

(51) Int. Cl.
*F41J 5/056* (2006.01)

(52) U.S. Cl.
CPC ..... *F41J 5/056* (2013.01)

(58) Field of Classification Search
CPC ..... F41J 5/056; F41J 5/06; G06F 3/043–0436
See application file for complete search history.

(56) References Cited

U.S. PATENT DOCUMENTS 5,095,433 A * 3/1992 Botarelli ..... F41J 5/056 434/23
5,491,305 A * 2/1996 Kawakami ..... G06F 3/0433 345/177

(Continued)

FOREIGN PATENT DOCUMENTS

FR 3 056 780 B1 3/2018
FR 3 057 368 A1 4/2018

(Continued)

OTHER PUBLICATIONS

English machine translation of Choi, KR 20130037287 A (Year: 2013).*

(Continued)

*Primary Examiner* — Laura Davison
(74) *Attorney, Agent, or Firm* — Oblon, McClelland, Maier & Neustadt, L.L.P.

(57) ABSTRACT

This installation for locating impacts comprises an interactive plate, at least three transducers arranged and distributed against the interactive plate in order to pick up progressive mechanical waves propagating therein and to transform them into electrical signals, and an electronic central unit programmed to locate an impact in the interactive plate by an analysis of the electrical signals that it receives from the transducers. It further includes an additional plate attached to the front face of the interactive plate and having an impact-receiving zone, and means for attaching the additional plate to the interactive plate, configured to ensure contact against the entire portion of the front face of the interactive plate located opposite the impact-receiving zone of the additional plate.

9 Claims, 2 Drawing Sheets

(56) References Cited

U.S. PATENT DOCUMENTS

Figure 1:
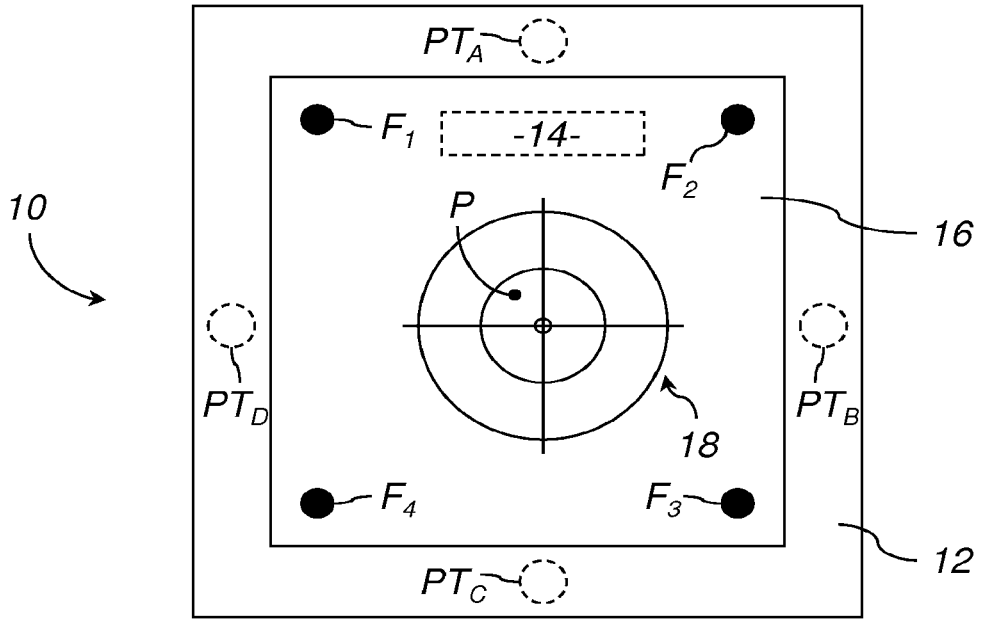

| | | | | |
|---|---|---|---|---|
| 6,367,800 | B1 * | 4/2002 | Sheck | F41J 5/056 273/371 |
| 7,685,862 | B1 | 3/2010 | Hughes et al. | |
| 2016/0305749 | A9 | 10/2016 | Mason | |
| 2019/0227690 | A1 | 7/2019 | Alexandre et al. | |
| 2019/0383583 | A1 * | 12/2019 | Carkner | G01N 29/045 |

FOREIGN PATENT DOCUMENTS

| | | | | |
|---|---|---|---|---|
| FR | 3 062 202 | A1 | 7/2018 | |
| KR | 20130037287 | A * | 4/2013 | F41J 5/052 |
| WO | 2018/060564 | A1 | 4/2018 | |

OTHER PUBLICATIONS

International Search Report dated Mar. 2, 2020 in PCT/FR2019/052663 filed Nov. 8, 2019, 2 pages.

Indian Office Action issued in Indian Patent Application No. 202117024715 dated Oct. 19, 2022, (w/ English translation).

* cited by examiner

SETUP FOR LOCATING IMPACTS WITH INTERACTIVE PLATE AND TRANSDUCERS

The present invention relates to an impact location installation, in particular for a recreational or sports shooting application.

The invention is more particularly applicable to a setup for accurate impact location, i.e., comprising:

- an interactive plate capable of propagating progressive mechanical waves from an impact, having a front face for receiving impacts;
- at least three transducers arranged and distributed against the front face or a rear face of the interactive plate, designed to pick up progressive mechanical waves propagating in the interactive plate and transform them into electrical signals; and
- an electronic central unit, connected to the transducers to receive their electrical signals, programmed to locate the impact in the interactive plate by an analysis of the electrical signals received.

An installation of this type is, for example, the subject matter of patent documents FR 3 056 780 B1 and FR 3 057 368 A1. The technology implemented, consisting of a precise positioning of the transducers and an analysis of the differences in propagation time of the progressive mechanical waves resulting from an impact towards the transducers on the basis of impact detection instants identified in the electrical signals, allows the precise localization desired for recreational or sports shooting applications. This is the technology implemented by the company Sport Quantum in its product "impaQt" (registered trademark).

But the repetition of shots on an interactive impact plate in the same zone is likely to finally cause a deformation of the plate by local sinking which harms the propagation of the waves and thus the accuracy of the measurement. The greater the deformation, the greater the measurement errors. This deformation is also a function of the impact energy and the number of impacts received per unit area. It is therefore a particularly sensitive problem for shooting sports applications in which the users are generally experienced shooters. The impacts are then powerful and often localized in very small areas around the sight center.

A first solution could be to consider the interactive plate as a consumable device to be replaced regularly. But its cost can be relatively important considering the precise positioning of the transducers and the constraints of connection with the electronic central unit.

Another solution proposed by the company Sport Quantum for its "impaQt" product (registered trademark) consists of inclining the interactive plate along one or more freely chosen axes to protect it against impacts of excessive power or energy. Indeed, the higher the inclination in relation to the plane orthogonal to the desired sight and/or shooting axis, the more the impact energy is reduced by deviating the trajectory of the projectile without stopping it, which has the effect of increasing the resistance of the interactive plate to high powers/energies and therefore its life span. But this solution only delays the necessary replacement of the plate and this is not fully satisfactory.

Another solution also proposed by the company Sport Quantum for its product "impaQt" (registered trademark) consists of moving the target representation intended to be displayed in a plane of the interactive plate to distribute, at least in the central zone of the interactive plate, the impacts received per unit area. This alternative solution only delays the necessary replacement of the plate too and is not fully satisfactory either. It also requires mechanical or electronic means for moving the target representation. Finally, it is unsatisfactory in practice because an experienced shooter will notice the change in position of the display during a series of shots. This requires the shooter to physically move to follow this change in position and is not ideal for tracking performance.

It may thus be desirable to provide an impact location installation which allows to overcome at least part of the above-mentioned problems and constraints.

It is therefore proposed an impact location installation, comprising:

- an interactive plate capable of propagating progressive mechanical waves from an impact, having a front face for receiving impacts;
- at least three transducers arranged and distributed against the front face or a rear face of the interactive plate, designed to pick up progressive mechanical waves propagating in the interactive plate and transform them into electrical signals; and
- an electronic central unit, connected to the transducers to receive their electrical signals, programmed to locate the impact in the interactive plate by an analysis of the electrical signals received;

further comprising:

- an additional plate attached to the front face of the interactive plate and having an impact receiving zone; and
- means for attaching the additional plate to the interactive plate, configured to ensure contact against the entire front face portion of the interactive plate located opposite the impact receiving zone of the additional plate.

Thus, the additional plate absorbs the energy of the incident impacts and protects the interactive plate while ensuring effective propagation of progressive mechanical waves in the interactive plate from each direct impact it receives through the attaching means as configured above. It is therefore the additional plate that is deformed by the impacts and must be replaced regularly. But as it does not carry the transducers, its replacement is much simpler and more economical than that of the interactive plate.

Optionally, the attaching means include means for mechanically clamping the additional plate against the interactive plate.

Also optionally, the mechanical clamping means comprise screw and nut systems arranged at the periphery of the additional plate.

Also optionally, the attaching means include a contact-making layer against the entire front face portion of the interactive plate opposite the impact receiving zone of the additional plate, which layer is interposed between the interactive plate and the additional plate.

Also optionally, the contact-making layer is made of a material comprising an adhesive, especially an epoxy and/or transparent adhesive.

Also optionally, the contact-making layer is made of a material comprising a double-sided adhesive sheet, especially a repositionable adhesive sheet.

Also optionally, the contact-making layer is designed in a liquid material extending throughout the entire impact receiving zone of the additional plate by capillary action.

Also optionally, the attaching means include:

- at least one rigid reinforcement plate or bar attached, at the rear of the interactive plate, to both the interactive and additional plates; and at least one spacer disposed between central portions of the interactive plate and said at least one rigid reinforcing plate or bar so as to bend the interactive plate and the additional plate.

Also optionally:

the interactive plate is designed in one of the materials of the set consisting of polycarbonate, glass, tempered glass and metal;

the additional plate is made of one of the materials of the set consisting of metal sheet, polycarbonate, glass, tempered glass and ceramics of the type aluminum oxynitride, aluminum oxide, yttrium oxide or other.

Also optionally, an impact location installation according to the invention may comprise, for a recreational or sports shooting application, a target representation to be displayed in a plane of the interactive plate or of the supplementary plate.

Figure 2:
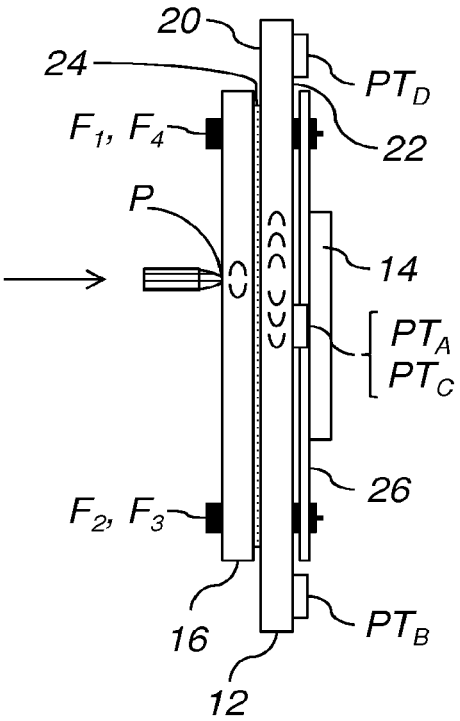
Figure 3:
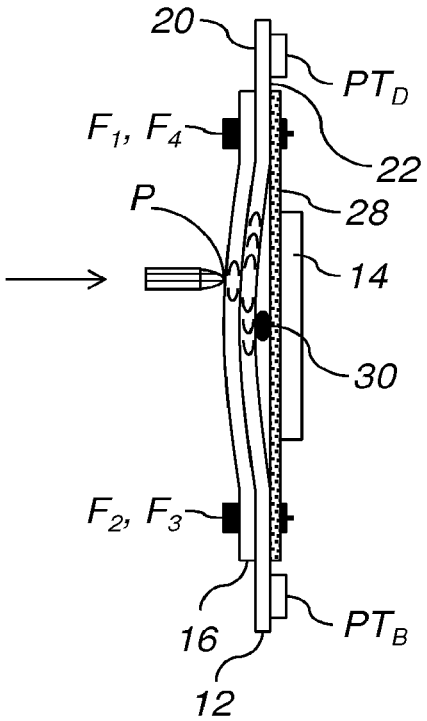
Figure 4:
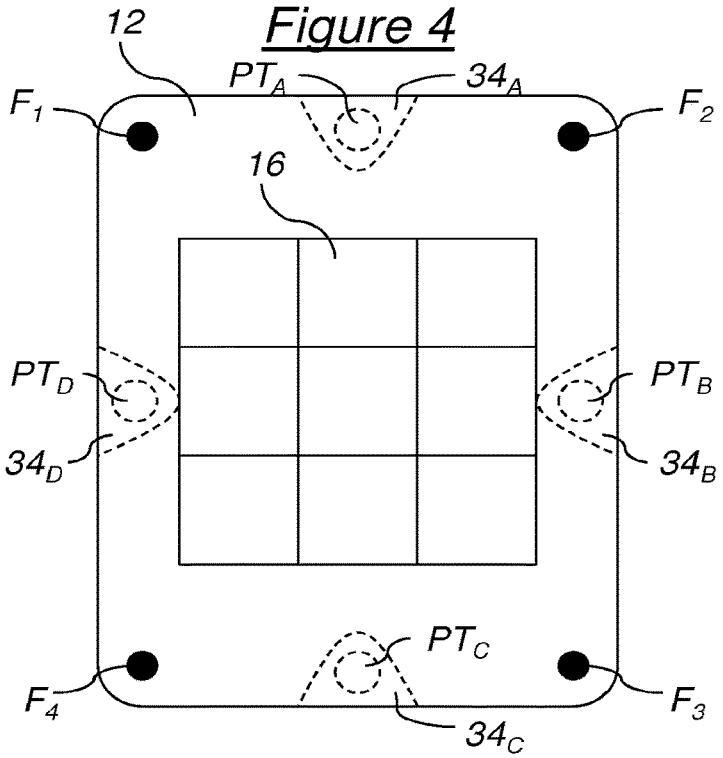
Figure 5:
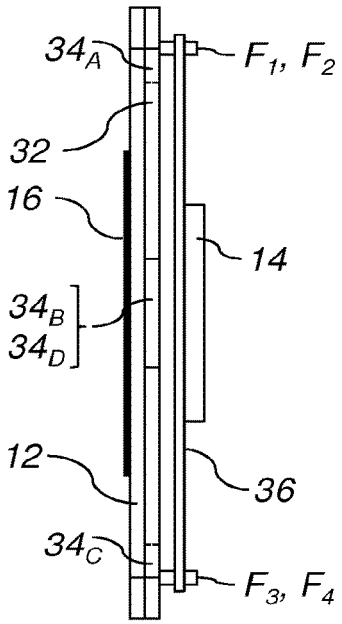
Figure 6:
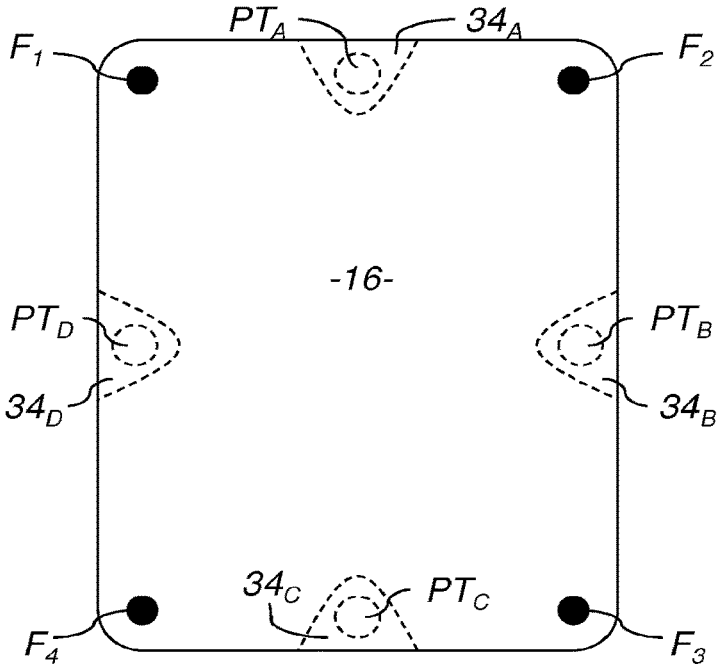
Figure 7:
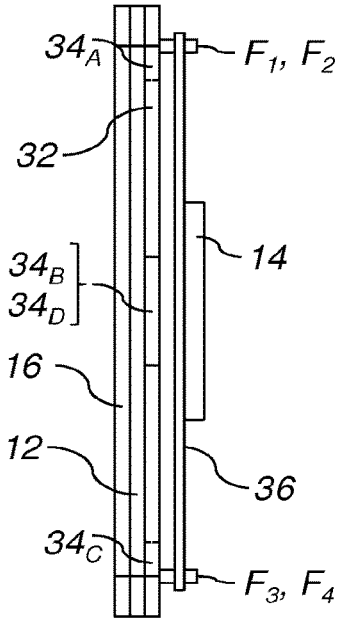

The invention will be better understood via the following description, given only as an example and made in reference to the appended drawings in which:

FIG. 1 diagrammatically shows a front view of the general structure of an impact location installation, according to a first embodiment of the invention;

FIG. 2 diagrammatically shows a top view of a first variant of the impact location installation of FIG. 1;

FIG. 3 diagrammatically shows a top view of a second variant of the impact location installation of FIG. 1;

FIG. 4 diagrammatically shows a front view of the general structure of an impact location installation, according to a second embodiment of the invention;

FIG. 5 diagrammatically shows a side view of the impact locating installation of FIG. 4;

FIG. 6 diagrammatically shows a front view of the general structure of an impact location installation, according to a third embodiment of the invention; and FIG. 7 diagrammatically shows a side view of the impact location installation of FIG. 6.

The impact location installation 10, diagrammatically shown in FIG. 1 in front view, comprises an interactive plate 12 capable of propagating progressive mechanical waves from an impact P, and a device for locating any impact against this interactive plate 12. The front face of the interactive plate 12 is visible in FIG. 1.

The locating device comprises:

four transducers $PT_A$, $PT_B$, $PT_C$ and $PT_D$ arranged and distributed against a rear face of the interactive plate 12, more precisely at the respective middles of the four edges of the rectangle it forms, designed to pick up the progressive mechanical waves propagating in the interactive plate 12 and transform them into electrical signals; and a central electronic unit 14, connected to the transducers $PT_A$, $PT_B$, $PT_C$ and $PT_D$ to receive their electrical signals, programmed to locate the impact P in the interactive plate 12 by an analysis of the received electrical signals, for example an analysis of the propagation time differences of the progressive mechanical waves coming from the impact P towards the transducers $PT_A$, $PT_B$, $PT_C$ and $PT_D$ on the basis of detection instants of the impact P identified in the received electrical signals.

It should be noted that, in general, the interactive plate 12 is any shape, not necessarily rectangular. The number of transducers is also arbitrary, at least equal to three to allow locating by analysis of propagation time differences as taught for example in the aforementioned document FR 3 056 780 B1. Alternatively, they can be placed against the front face of the interactive plate 12.

The impact locating installation 10 further comprises an additional rectangular plate 16 attached to the front side of the interactive plate 12 and having an impact receiving zone. This zone covers the entire surface of the plate, for example, and includes a representation of a target 18 visible to a user for a recreational or sports shooting application. Alternatively, it could cover only a portion of its surface. The additional plate 16 is bare, i.e. it is not equipped with any sensor.

Finally, the impact location installation 10 includes means for attaching the additional plate 16 to the interactive plate 12, configured to ensure contact against the entire portion of the front face of the interactive plate 12 located opposite the impact reception zone of the additional plate 16. In the embodiment shown in FIG. 1, these attaching means include four screw and nut systems $F_1$, $F_2$, $F_3$ and $F_4$ arranged at the four corners of the rectangle formed by the additional plate 16. They provide a mechanical clamping function at the periphery of the additional plate 16. It should also be noted that, in general, the additional plate 16 is any shape, not necessarily rectangular. The number of screw and nut systems is also arbitrary, knowing that they must at least ensure the contact defined above with the front face of the interactive plate 12. As shown in FIG. 1, it should be noted that the screw and nut attaching systems are advantageously arranged outside the polygon formed by the transducers to disturb as little as possible the propagation of the progressive mechanical waves to be detected.

A first variant embodiment of the impact location installation 10 is shown in FIG. 2 in top view. The front face 20 of the interactive plate 12, against a portion of which contact is ensured by the attaching means, and the rear face 22, against which the transducers $PT_A$, $PT_B$, $PT_C$ and $PT_D$ are arranged, are shown in side view. In this variant, the attaching means comprise not only the four screw and nut systems $F_1$, $F_2$, $F_3$ and $F_4$ but also a layer 24 for establishing the desired mechanical contact over the entire impact reception zone. It is interposed between the interactive plate 12 and the additional plate 16. This layer 24 allows the shock waves of any impact P to be transmitted from the additional plate 16 to the interactive plate 12 for reception by the transducers $PT_A$, $PT_B$, $PT_C$ and $PT_D$. The material of this layer 24 may be an adhesive, for example a transparent adhesive, for example also an epoxy type adhesive. It can also be a double-sided adhesive sheet, in particular a repositionable adhesive sheet allowing a simple and fast replacement of the additional plate 16 when it becomes too deformed by impacts. It should be noted that when the desired contact can be provided sufficiently securely by this layer 24, the four screw and nut systems $F_1$, $F_2$, $F_3$ and $F_4$ are optional. It should also be noted that the layer 24 may be made of a non-sticky, non-adhesive material, such as a liquid that spreads by capillary action throughout the entire impact receiving zone to ensure contact and transmission of shock waves while allowing easy replacement of the additional plate 16 when it becomes necessary. In this first embodiment, the electronic central unit 14 is arranged against a third support plate or bar 26, which is itself fixed, for example, to the rear of the interactive plate 12, without direct contact with it, by means of the four screw-and-nut systems $F_1$, $F_2$, $F_3$ and $F_4$.

A second variant embodiment of the impact location installation 10 is shown in a top view in FIG. 3. In this variant, the four screw and nut systems $F_1$, $F_2$, $F_3$ and $F_4$ secure the interactive plate 12 and the additional plate 16 together, but also at least one rigid reinforcing plate or bar 28 disposed against the rear face 22 of the interactive plate 12. The fastening means then comprise not only the four screw and nut systems F1, F2, F3 and F4 but also said at least one rigid reinforcing plate or bar 28 and at least one pin 30 forming a spacer between the central parts of the interactive plate 12 and the rigid reinforcing plate or bar 28, so as to slightly bend the interactive plate 12 and, by translation of the forces, the additional plate 16. The pin 30 is, for example, small so that the bending is not perceptible from a distance, while being of sufficient size to provide the desired mechanical contact over the entire impact receiving zone. Several pins can be provided, for example two pins one below the other. In this second variant, there is no need to provide a layer 24 such as that shown in FIG. 2. The transmission of shock waves from the additional plate 16 to the interactive plate 12 for reception by the transducers $F_1$, $F_2$, $F_3$ and $F_4$ is therefore direct. Also in this second variant, the central electronic unit 14 can be attached directly to the available rear side of the rigid reinforcing plate or bar 28. This second variant also allows easy replacement of the additional plate 16 when necessary.

In terms of materials, the interactive plate 12 can be made of polycarbonate, glass, tempered glass, metal, etc. As it is not directly subjected to impacts because it is protected by the additional plate 16, it is not susceptible to deformation or alteration.

The additional plate 16 must be made of a material capable of absorbing the energy of the impacts generated by the projectiles that it directly receives. Since it is the plate that is likely to be replaced as a result of the deformations that it undergoes, it can also advantageously be designed in a cheap material. For example, it can be a simple metal sheet cut to size with four holes to accommodate the four screw-and-nut systems $F_1$, $F_2$, $F_3$ and $F_4$. In this case, the target representation should be printed or displayed on the front of the metal sheet. In the case of lower impact energies, it can be polycarbonate or even glass. Indeed, although glass is brittle because it is resistant to compression but sensitive to tension, it is then protected by the contact established with the interactive plate 12 over the entire impact reception zone. It then allows a very good resistance of the additional plate 16 to abrasion. In this case, the target representation can be printed or displayed in any plane of the interactive plate 12 or of the additional plate 16 and be visible from a distance by transparency (subject to the transparency of the layer 24 if necessary). It should also be noted that the use of glass is not suitable for the variant embodiment shown in FIG. 3, as the glass does not support being bent.

Another solution consists of designing an additional plate 16 in a more impact resistant and therefore more expensive material. However, this additional material cost can be offset by a smaller thickness of the additional plate 16. An example is shown in FIGS. 4 (front view) and 5 (side view). In this example, the additional plate 16 is made of aluminum oxynitride ceramic, which is a very abrasion and scratch resistant material. It is further transparent. Any other material with equivalent properties is also suitable, such as aluminum oxide or yttrium oxide ceramic. The additional plate 16 can be made in one piece or in several separate pieces as shown in FIG. 4 (i.e. nine square pieces). It is glued to the front face of the interactive plate 12, tempered glass, which is itself attached to a reinforcing plate 32, e.g., polycarbonate, by means of attaching elements identified by the black disks at the four corners as well as by gluing. These attaching elements are for example the four systems $F_1$, $F_7$, $F_3$ and $F_4$ with screws and nuts. The reinforcing plate 32, also devoid of sensors and advantageously fulfilling a function of absorbing part of the energy of each shot, is in contact against the rear face of the interactive plate 12. Four notches $\mathbf{34}_A$, $\mathbf{34}_B$, $\mathbf{34}_C$ and $\mathbf{34}_D$ are furthermore formed respectively in the central portions of the four edges of the reinforcing plate 32 to receive the four transducers $PT_A$, $PT_B$, $PT_C$ and $PT_D$ disposed against the rear face of the interactive plate 12. Finally, a support plate or bar 36, on which the electronic central unit 14 is disposed, is fixed to the rear of the reinforcing plate 32, without direct contact with it, by means of the four screw-and-nut systems $F_1$, $F_2$, $F_3$ and $F_4$.

Another solution, as shown in FIGS. 6 (front view) and 7 (side view), differs from the previous one in that it consists of designing the additional plate 16 with the same lateral dimensions as the interactive plate 12 and of fixing them together, and with the reinforcement plate 32, by gluing and/or using attaching elements identified by the four screw and nut systems $F_1$, $F_2$, $F_3$ and $F_4$ at the four corners. The additional plate 16 is for example made of tempered glass, the interactive plate 12 is made of glass or tempered glass and the reinforcing plate 32 is made of polycarbonate or polymethylmethacrylate.

It should be noted that, in a recreational or sports shooting use of the above-described installation, the electronic central unit 14 can be easily programmed to record in memory the history of impacts received directly by the additional plate 16, including their respective locations and powers. Thanks to this information, the deformation of the additional plate 16 can be predicted automatically and its replacement can be anticipated by defining a threshold of deformation parameter, local and/or global, not to be exceeded.

It is clear that an impact location installation such as the one described above according to several embodiments and variants allows to effectively protect the interactive plate 12 provided with transducers and connected to an electronic central unit 14 for processing the signals provided by the transducers. The additional plate 16 as described above has at least two advantages. First of all, it is more easily replaceable and at a more attractive cost because it is not itself equipped with sensors. In addition, it can be made of a material that is technically more impact resistant than the interactive plate 12, which is particularly advantageous in applications where it is subjected to very high energy projectile impacts. As a result, it is possible to design a high-quality interactive plate with precisely placed transducers without fear of damage.

It should also be noted that the invention is not limited to the embodiments or applications described above.

In particular, only a sport or recreational target shooting application has been described above, but other applications using impact position measurements can also be envisaged.

It will be more generally apparent to those skilled in the art that various modifications can be made to the above-described embodiments and applications in light of the teaching just disclosed. In the above detailed presentation of the invention, the terms used should not be construed as limiting the invention to the embodiments and applications set forth in the present description, but should be construed to include all equivalents the anticipation of which is within the reach of those skilled in the art by applying their general knowledge to the implementation of the teaching just disclosed to them.

The invention claimed is:

1. An impact location installation comprising:

an interactive plate capable of propagating progressive mechanical waves from an impact, having a front face for receiving impacts;

at least three transducers arranged and distributed against the front face or a rear face of the interactive plate, designed to pick up progressive mechanical waves propagating in the interactive plate and transform them into electrical signals; and an electronic central unit, connected to the transducers to receive their electrical signals, programmed to locate the impact in the interactive plate by an analysis of the received electrical signals;

wherein the impact location installation further comprises:

an additional plate attached to the front face of the interactive plate and having an impact receiving zone; and means for attaching the additional plate to the interactive plate, configured to ensure contact against an entirety of a portion of the front face of the interactive plate that is opposite the impact receiving zone of the additional plate, wherein the attaching means includes:

at least one rigid reinforcement plate or bar attached, at the rear face of the interactive plate, to both the interactive and additional plates, and at least one spacer disposed between central portions of the interactive plate and the at least one rigid reinforcement plate or bar so as to bend the interactive plate and the additional plate.

2. The impact location installation according to claim 1, wherein the attaching means comprise means for mechanically clamping the additional plate against the interactive plate.

3. The impact location installation according to claim 2, wherein the mechanical clamping means comprise screw and nut systems arranged at a periphery of the additional plate.

4. The impact location installation according to claim 1, wherein the attaching means comprises a contact-making layer against the entirety of the portion of the front face of the interactive plate that is opposite the impact receiving zone of the additional plate, said contact-making layer being interposed between the interactive plate and the additional plate.

5. The impact location installation according to claim 4, wherein the contact-making layer made of a material containing an adhesive, in particular an epoxy and/or transparent adhesive.

6. The impact location installation according to claim 4, wherein the contact-making layer is made of a material comprising a double-sided adhesive sheet, in particular a repositionable adhesive sheet.

7. The impact location installation according to claim 4, wherein the contact-making layer is made of a liquid material extending between the entirety of said portion of the front face of the interactive plate and of the impact receiving zone of the additional plate by capillary action.

8. The impact location installation according to claim 1, wherein:

the interactive plate is designed in one of the materials of the set consisting of polycarbonate and metal;

the additional plate is made of one of the materials of the set consisting of metal sheet, polycarbonate and ceramic of the type aluminum oxynitride, aluminum oxide, or yttrium oxide.

9. The impact location installation according to claim 1, for a recreational or sports shooting application, comprising a target representation to be displayed in a plane of the interactive plate or of the additional plate.

* * * * *